US006011465A

United States Patent [19]

Wang

[11] Patent Number: 6,011,465

[45] Date of Patent: Jan. 4, 2000

[54] BACKUP ARRANGEMENT FOR ALARM SYSTEM

[76] Inventor: Randall Wang, 5209 N. Tyler Ave., Temple City, Calif. 91780

[21] Appl. No.: 09/105,774

[22] Filed: Jun. 26, 1998

[51] Int. Cl.[7] ..... G08B 29/00

[52] U.S. Cl. ..... 340/506; 340/507; 340/693.2; 340/333

[58] Field of Search ..... 340/506, 507, 340/693.1, 693.2, 333

[56] References Cited

U.S. PATENT DOCUMENTS

| | | | |
|---|---|---|---|
| 3,641,570 | 2/1972 | Thompson | 340/693.3 |
| 3,702,469 | 11/1972 | Golja | 340/333 |
| 4,698,621 | 10/1987 | Masot | 340/693 |
| 5,552,764 | 9/1996 | Tsujimoto | 340/508 |
| 5,654,691 | 8/1997 | Wang | 340/507 |

*Primary Examiner*—Donnie L. Crosland
*Attorney, Agent, or Firm*—Raymond Y. Chan; David and Raymond

[57] ABSTRACT

A backup arrangement for alarm system includes an electronic switch circuit, a DC power source, a build-in electronic Hi-sounder, and a chargeable resistor. The electronic switch circuit, which is a IC control system, has a power input connected to an auxiliary power output of a control panel of a burglary alarm system installed in house or vehicle, and an alarm input connected to an alarm output of the control panel. The electronic switch circuit further includes a normally opened switch and a normally closed switch. The normally closed switch is coupled in series with the alarm output of the control panel and the input of the build-in electronic Hi-sounder. The DC power source has an output connected in series with the normally opened switch and the input of the build-in electronic Hi-sounder. An alert output is connected to a system warning device of the burglary alarm system. Accordingly, when the control panel and wiring are vandalized that the auxiliary power output losses its voltage or power or that the system warning device is shock off or damaged, then the normally closed switch is switched to an open condition and the normally opened switch is switched to a close condition. At that time, the DC power source will energize the builder-in electronic Hi-sounder to provide Hi-pitch warning alarm.

18 Claims, 4 Drawing Sheets

BACKUP ARRANGEMENT FOR ALARM SYSTEM

CROSS REFERENCE OF RELATED APPLICATION

This application is an improvement of a U.S. Pat. No. 5,654,691, issued to the inventor of this application on Aug. 5, 1997.

FIELD OF THE PRESENT INVENTION

The present invention relates to an auxiliary backup device of burglary alarm system, and more particularly to a backup arrangement to safeguard a security alarm system, such as burglary alarm system, car alarm system, fire alarm system, and/or CCTV alarm system. The backup arrangement, which is connected to a security alarm control panel or the power supply of the CCTV system, comprises a build-in audible and/or voice warning device such as an electronic Hi-sounder and/or exterior siren, etc. In case the alarm system or the CCTV system or its wiring is vandalized, the backup arrangement will detect the situation and output alarm to siren(s) speaker with voice module warning device, and thus defer and prevent further damage from the intruder.

BACKGROUND OF THE PRESENT INVENTION

Traditional security alarm system consists of security alarm control, access control, audible and voice warning device, etc. in order to achieve better security. However, no matter how integrated and intelligent the traditional burglary alarm systems are, they can be easily destroyed to lose its efficacy by a thief who is acquainted with the burglary alarm system. Since all appliances of the burglary alarm system demand on the power output of the burglary control panel, wires are linked from the control panel to each appliance respectively. Furthermore, the burglary control panel is installed at a predetermined location in house, such as in closet, storeroom, basement, attic, or near the entrance or exit. Although the burglary alarm system will be activated when burglars break in, experienced burglars can reach the control panel within a very short time and damage the control panel by immediately cutting all the wires connected therefrom. Once the control panel and wiring are vandalized by the intruder, the whole burglary alarm system is de-energized and loses its function and efficacy due to power lost.

To some more skillful burglars, there is a more simple way to achieve a power lost condition, which de-energizes the whole burglary alarm system, by burning the fuses in the control panel. Since the motion detectors and glass break detectors of the burglary alarm system are connected to the power source and located at those obvious places (such as the edges of doors and windows), burglars can simply short the power wires to burn out the fuses of control panel. Furthermore, the burglars can break or drill a hole on the window in order to reach the motion or glass break detectors and short the power wires immediately for burning the fuses. Thus, the whole burglary alarm system is de-energized and loses its function and efficacy.

U.S. Pat. No. 5,654,691 successfully solves the above problems by suggesting an auxiliary backup device of burglary alarm system which can monitor the voltage of the auxiliary power output from an burglary control panel. When the control panel and wiring are damaged, the auxiliary backup device will detect the interruption of the auxiliary power voltage and energize the output of an alarm device consisting audible and/or visual alarm to defer and prevent further damage from the intruder by an easy and economic way.

However, if a skillful burglary cut off its power supply or to electrically connect two power wires of the system warning device to cause electrical shock, the siren or sounder of the system warning device may still be de-activated, and thus the entire burglary alarm system as well as the auxiliary backup device can not provide warning alarm anymore. Moreover, the electrical relay circuit equipped in the auxiliary backup device is not as reliable as electronic components.

SUMMARY OF THE PRESENT INVENTION

The main object of the present invention is to provide a backup arrangement for security alarm system (such as burglary alarm system, car alarm system and fire alarm system) connected to a security alarm control panel, which comprises a build-in audible and/or voice warning device, preferable an electronic Hi-sounder, so that when an interruption of the control panel is detected or even the system warning device is damaged, the build-in audible and/or voice warning device will be activated to provide warning alarm for deferring and preventing further damage from the intruder.

Another object of the present invention is to provide a backup arrangement for alarm system which has a relatively small size and simplified inexpensive configuration by incorporating an electronic switch circuit, so that the backup arrangement for alarm system is more easier to install in any concealed place, such as in the ceiling, within a cabinet, behind a furniture, a picture frame, or a plant, etc., or feigning to be a fake socket on wall.

Another object of the present invention is to provide a backup arrangement that is also adapted to provide protection for the CCTV system.

In order to accomplish the above objects, the present invention provides a backup arrangement of alarm system which comprises in combination an electrical circuitry having an electronic switch circuit, a DC power source, a build-in electronic Hi-sounder, a fuse member, and a chargeable resistor. The electronic switch circuit, which is a IC control system, has a power input connected to an auxiliary power output of a control panel of a burglary alarm system installed in house or vehicle, and an alarm input connected to an alarm output of the control panel. The electronic switch circuit further comprises a normally opened switch and a normally closed switch. The normally closed switch is coupled in series with the alarm output of the control panel and the input of the build-in electronic Hi-sounder. The DC power source comprises at least a DC battery which output is connected in series with the normally opened switch of the electronic switch circuit and the input of the build-in electronic Hi-sounder. The backup arrangement of the present invention further has an alert output connected to a system warning device of the burglary alarm system installed in house or vehicle.

Accordingly, when the control panel works normally that the voltage of the auxiliary power output of the control panel is high (11–14 volt.), the normally closed switch is in a close condition and the normally opened switch is in an open condition, so that the alarm output of the control panel is connected directly to the input of the system warning device via the alert output of the backup arrangement. If the control panel and wiring are vandalized that the auxiliary power output losses its voltage or power or that the system warning device is shock off or damaged, then the normally closed switch is switched to an open condition and the normally opened switch is switched to a close condition. At that time, the DC power source will energize the builder-in electronic Hi-sounder to provide Hi-pitch warning alarm by self battery (9V).

DETAILED DESCRIPTION OF THE PREFERRED EMBODIMENT

Figure 1:
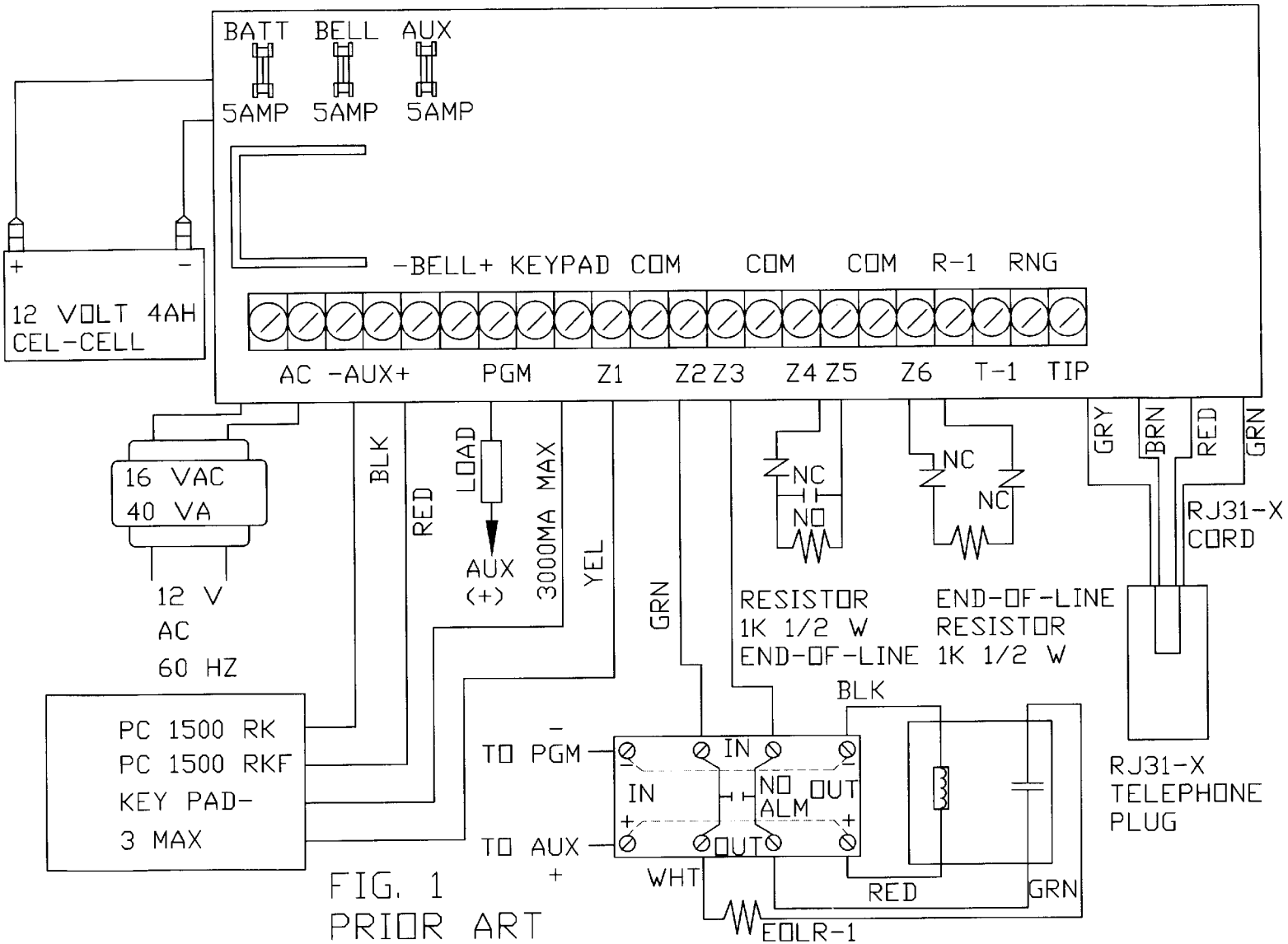
FIG. 1 PRIOR ART
FIG. 1 is a schematic view of a control panel of traditional burglary alarm system.
Figure 2:
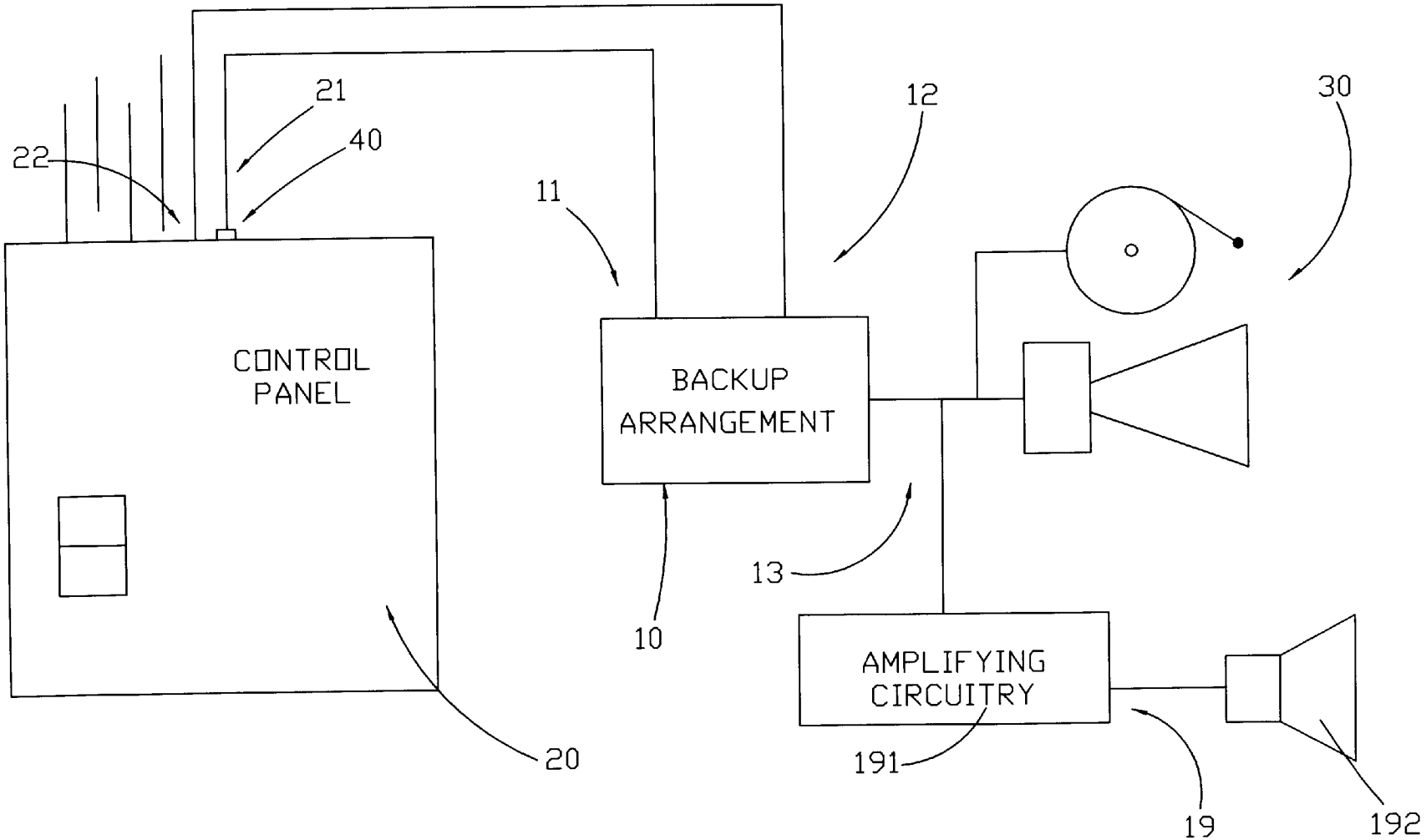
FIG. 2 is a schematic block diagram illustrating a backup arrangement of the present invention equipped between a traditional burglary control panel and a system warning alarm.

FIG. 2 illustrates a backup arrangement 10 incorporated between a burglary or fire alarm control panel 20 and a system warning alarm 30 of a burglary or fire alarm system. The backup arrangement 10 has a power input 11, an alarm input 12, and an alert output 13. The power input 11 has a positive and a negative terminals respectively connected to a positive and a negative terminals of an auxiliary power output 21 or a 12V DC output of the alarm control panel 20 (as shown in FIG. 1) by two conductor cables. The alarm input 12 has a positive and a negative terminals connected to the alarm output 22, such as the BELL or SIREN positive and negative terminals of the control panel 20 (as shown in FIG. 1) by two conductor cables respectively. The alert output 13 has a positive and a negative output terminals connected to an input of the system warning device 30 by two conductor cables respectively. The system warning device 30 is an audible and/or visible warning device which may consist of siren, bell, horn, buzzer, chime, sounder, speaker (with driver), strobe light, warning light, or warning lamp.

Figure 3:
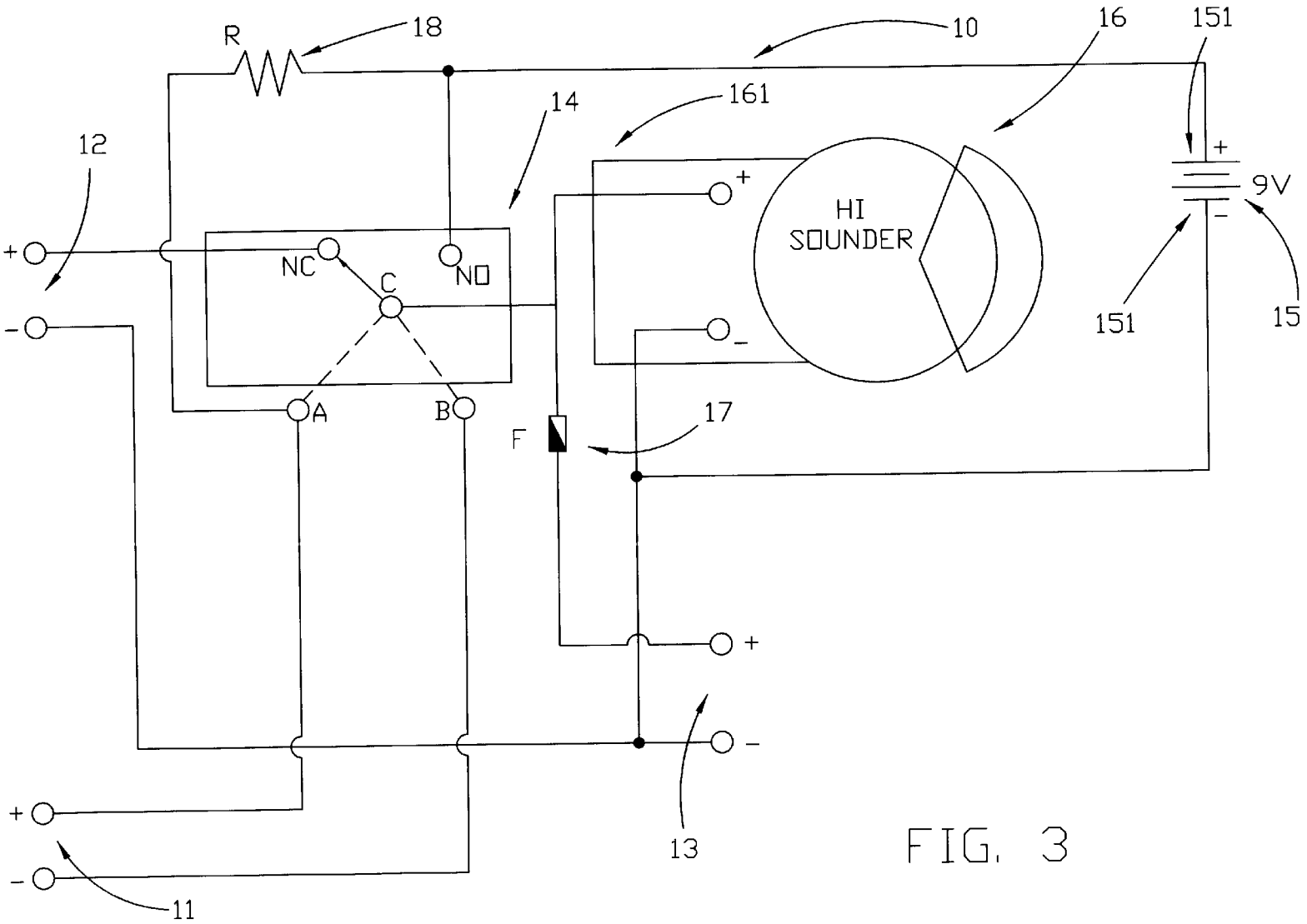
FIG. 3 is a schematic block diagram of a backup arrangement for alarm system according to a preferred embodiment of the present invention.
Figure 4:
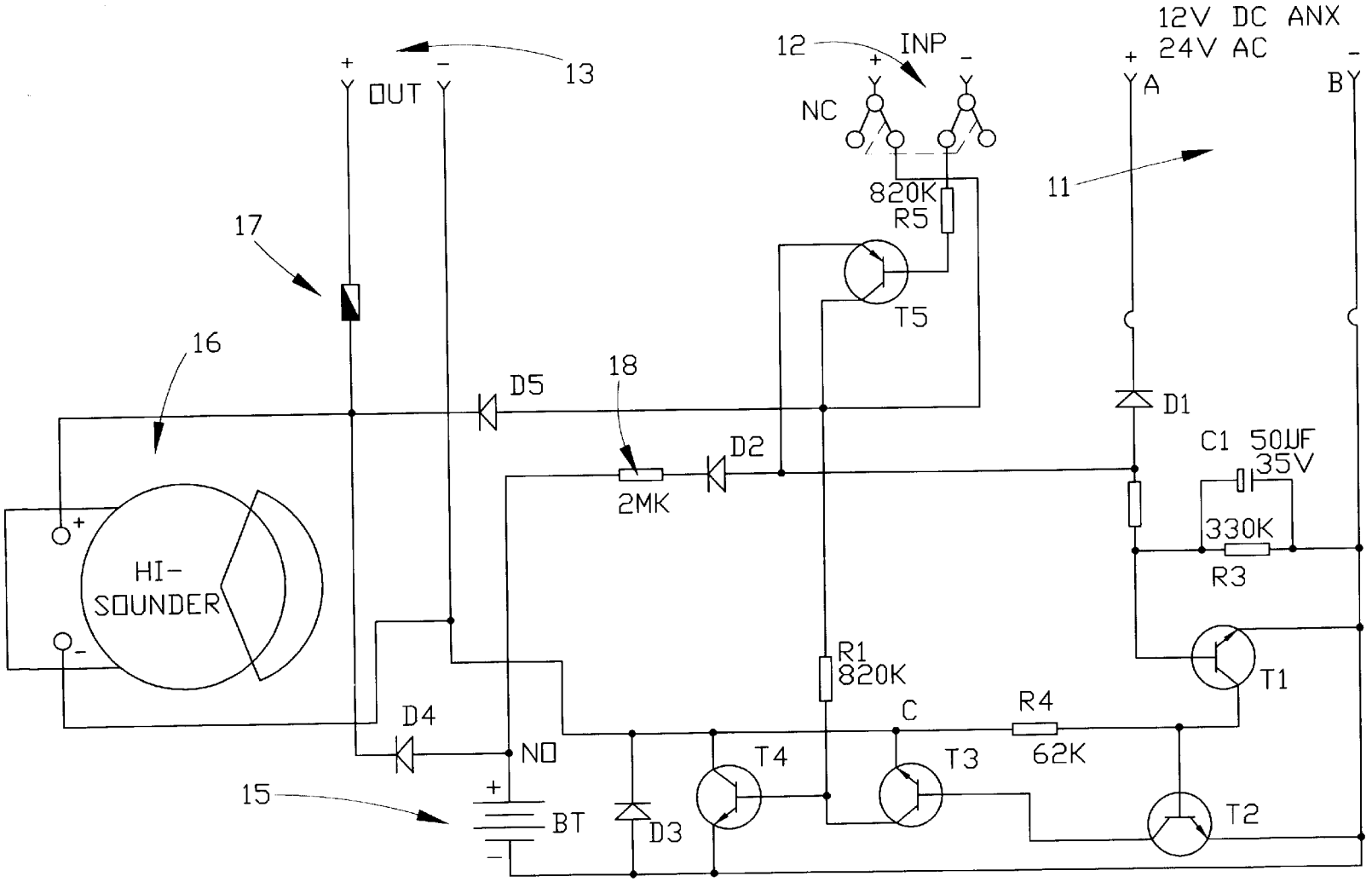
FIG. 4 is an electrical circuit diagram of the backup arrangement for alarm system according to the above preferred embodiment of the present invention.

Referring to FIGS. 2 and 3, the backup arrangement of the security alarm system comprises in combination an electrical circuitry having an electronic switch circuit 14, a DC power source 15, a build-in electronic Hi-sounder 16, a fuse member 17, and a chargeable resistor 18. The electronic switch circuit 14, which is a IC control system, comprises a power input serving as the power input 11 of the backup arrangement 10 and connecting to the auxiliary power output 21 of the control panel 20 of the security alarm system installed in house or vehicle. The electronic switch circuit 14 also comprises an alarm input serving as the alarm input 12 of the backup arrangement 10 and connecting to the alarm output 22 of the control panel 20. The alarm input 12 is a manually selective switch for different panel output, i.e. the positive output or negative output, as shown in FIG. 4. Accordingly, the electronic switch circuit 14 defines a normally opened switch means NO and a normally closed switch means NC. As shown in FIG. 3, the normally closed switch means NC is coupled in series with the alarm output 22 of the control panel 20 via the alarm input 12 and a sounder input 161 of the build-in electronic Hi-sounder 16. The DC power source 15 comprises at least a DC battery which output 151 is coupled in series with the normally opened switch means NO of the electronic switch circuit 14 and the sounder input 161 of the build-in electronic Hi-sounder 16. The alert output 13 of the backup arrangement 10 of the present invention is connected to the system warning device 30 of the security alarm system installed in house or vehicle.

As shown in FIG. 4, the detail circuit of the electronic switch circuit (IC control system) 14 is illustrated, wherein the electronic switch circuit 14 further comprises five transistors T1–T5, five resistors R1–R5, five diodes D1–D5, and a capacitor C1.

Two terminals of the power input 11 are respectively connected with an input of the diode D1 and an output terminal of the transistor T1. An output of the diode D1 is connected in series with the resistor R2(33K) which is further connected in series with a base terminal of the transistor T1. The resistor R3 (330K) is connected in parallel with the transistor T1. The capacity C1 (50 $\mu$F, 35V) is connected in parallel with the resistor R3.

The input terminal of the transistor T1 is connected to a base terminal of the transistor T2 and the resistor R4 (62K) which is further connected to an output terminal of the transistor T3. An intersection point of the output terminal of the transistor T3 and the resistor R4 serves as the central terminal point C of the normally opened and closed switch means NO and NC as shown in FIG. 3. An input terminal of the transistor T2 is connected to a base terminal of the transistor T3. An output terminal of the transistor T2 is connected to the output terminal of the transistor T1 and an output terminal of the transistor T4. An input terminal of the transistor T3 is connected to the resistor R1 and a base terminal of the transistor T4. An input terminal of the transistor T4 is connected to the output terminal of the transistor T3. The diode D3 is connected in parallel with the transistor T4.

A negative terminal of the DC power source 15 is connected in series with an input of the diode D3 and a positive terminal of the DC power source 15 is connected to an input of the diode D4 and the chargeable resistor 18, wherein an intersection point of the diode D4 and the DC power source 15 serves as the NO terminal point of the normally opened switch means NO as shown in FIG. 3. Two terminals of the alert output 13 of the backup arrangement 10 are respectively connected to an output of the diode D4 and an output of the diode D3.

The chargeable resistor 18 is further connected to an output of the diode D2. An input of the diode D2 is connected to the resistor R2 and an output terminal of the transistor T5. An input terminal of the transistor T5 is connected to the resistor R1 and an input of the diode D5. A base terminal of the transistor T5 is connected to the resistor R5 which is further connected with a negative terminal of the alarm input 12. A positive terminal of the alarm input 12 serving as the NC terminal point of the normally closed switch means NC is connected in series with the input of diode D5. Two terminals of the sounder input 161 of the build-in electronic Hi-sounder 16 are respectively connected to an output of the diode D5 and the output of the diode D3.

Accordingly, as shown in FIGS. 2 to 4, when the control panel 20 works normally that the voltage of the auxiliary power output 21 of the control panel 20 is high (11–14 volt.), the normally closed switch means NC is in a close condition and the normally opened switch means NO is in an open condition, so that the alarm output 22 of the control panel 20 is connected directly to the input of the system warning device 30 via the alert output 13 of the backup arrangement 10. However, if the control panel 20 and wiring are vandalized that the auxiliary power output 21 losses its voltage or power, or that the system warning device 30 is shock off or damaged, then the normally closed switch means NC is switched to an open condition and the normally opened switch means NO is switched to a close condition. At that time, the DC power source 15 will energize the build-in electronic Hi-sounder 16 to provide Hi-pitch warning alarm automatically.

In accordance with the present invention, the chargeable resistor 18 of the backup arrangement, which is preferable to have 2 MK, is essential for charging the batteries of the DC power source 15 when the backup arrangement is not activated. The chargeable resistor 18 can also prevent current leakage of the batteries of the DC power source 15, so that the service life span of the DC power source 15 can thus be prolonged. The fuse member 17 is connected between the sounder input 161 of the build-in electronic Hi-sounder 16 and the alert output 13 for protecting the backup arrangement 10 due to its bypass function. The fuse member 17 is specifically installed for rendering the build-in electronic Hi-sounder 16 ineffective during the installation of the backup arrangement 10 of the present invention or when the system warning device 30 is manually and intentionally shorted. When the build-in electronic sounder 16 is activated, it would radially generate Hi-pitch warning sound which can be siren sound, voice warning with multi-languages.

In addition, as shown in FIGS. 2 and 3, the alert output 13 of the backup arrangement for alarm system of the present invention can further connected to voice warning device 19 which comprises a voice memory and amplifying circuitry 191 connected to at lease a speaker 192 which is preferred to be installed near the users.

The backup arrangement of the present invention can be installed in any desired concealed location, such as on the ceiling, behind a furniture, a picture frame, or a plant, etc. in a family room, within a cabinet or closet in bedroom, feigning to be a fake socket or phone and cable jack on wall, or the interior of an automobile. Although a burglary or intruder can easily reach and vandalize the alarm control panel 20 by damaging the panel or cutting all the wiring so as to damage the burglary alarm system for stopping the firing of alarm, the backup arrangement 10, once detecting the interruption of the normal power input, by monitoring the voltage of the auxiliary power output 21 from the control panel 20, will activate its DC power source 16 to supply power to the system alarm device 30 as well as the build-in electronic sounder 16. Thus, when the burglary or intruder predicates that the firing of the alarm system will vanish, the system alarm device 30 is energized by the backup arrangement to continue firing to defer and prevent further damage from the intruder. Even though the user forgets to switch on the security alarm system which no matter is arming or disarming, the warning device will still be energized once the control panel is destroyed by the burglary or intruder. Moreover, the voice warning device 19 will also be activated to provide speaking voice through the speaker 192 to warn the users.

The voice warning device 19 is especially useful for the fire alarm system. For example, when the fire alarm control panel or the wiring is vandalized by fire, the backup arrangement 10 of the present invention will also activate the voice warning device 19 to generate pre-memorized voice instruction to warn the users of the dangerous situation and where should they escape promptly and safely.

Furthermore, even the burglary or intruder damages the system alarm device 30 by cutting off or shocking off its wiring, the entire alarm system is backup by the build-in electronic sounder 16 that will be energized by the DC power source 15 to provide Hi-pitch warning alarm. The backup arrangement of the present invention not only adapts to backup the house alarm system, but also specifically is good to equip with the alarm system of automobile due to the fact that it is very easy for a skill burglary to damage the siren and battery of the car alarm system from underneath the car. Moreover, since the backup arrangement can be constructed by electronic components according to the present invention, it has a relatively small size and simplified inexpensive configuration, so that the backup arrangement for alarm system is more easier to install in any concealed place, such as in the ceiling, within a cabinet, or feigning to be a fake socket on wall.

The backup arrangement 10 of the present invention is designed for easy and low cost installation. It can be placed in an electrical one-gang box or ring and mounted in a concealed location. Moreover, a test switch 40, as shown in FIG. 2, can also be installed on the control panel 20 by connecting between the auxiliary power output 21 of the control panel 20 and the power input 11 of the backup arrangement 10. Therefore, the users is able to periodically test the system's operation and the battery contained in it by manually disconnected the power supply from the control panel 20 to backup arrangement 10 through the test switch 40. With some alarm control panels, smoke detector reset function performed on the keypad can be used for the test too.

Practically, if the protected premises are large, they can be divided into separate areas and external sirens or speakers can be added to cover each area. The backup arrangement 10 of the present invention is adapted for installing to any established security alarm system without the need of adding or removing any existing component thereof The installation steps are simply and easy, that is described as follows.

First, disconnect the AC power supply and battery to the alarm control panel 20.

Second, remove the battery(ies) 15 from the backup arrangement 10.

Third, connect the power input 11 of the backup arrangement 10 to the power output 21 of the alarm control panel 20, wherein the test switch 40 which is a normally close test switch can be connected between the two terminals for batteries and system test purposes. The test switch 40 can be installed on the control panel 20, mounted on the keypad, or in a location close to the control keypad of the alarm system. As mentioned above, if smoke detectors are provided in the alarm system, an alternative connection is to connect the power input 11 of the backup arrangement 10 to the positive and negative terminals of switched power output for smoke detectors on the alarm control panel 20. When connected this way, test can be performed on the keypad by punching the code for resetting smoke detectors and the test switch is not necessary to be installed.

Fourth, disconnect the system warning device 30 connected to the alarm output 22, i.e. the BELL or Siren terminals, of the control panel 20 and connect them to the alarm output 13 of the backup arrangement 10. If speakers are used, connect speakers to the speaker output terminals on the backup arrangement 10 too.

Fifth, connect the alarm output 12 of the backup arrangement 10 to alarm output 22 of the control panel 20.

Sixth, restore the AC power and batteries to the alarm control panel 20.

Seventh, connect 9V battery(ies) to the backup arrangement 10.

The backup arrangement 10 of the present invention can also be used to protect CCTV system, wherein the power supply wire to each camera can further be connected to the power input 11 of a backup arrangement 10, so that when the power supply of an individual camera is short, the particular backup arrangement 10 will be activated immediately. Moreover, if the main power supply wire for all cameras are short or the control panel 20 is vandizated, all the backup arrangements will be activated to provide warning alarm.

What is claimed is:

1. A backup arrangement for an alarm system, which is connected between an alarm output and an auxiliary power output of a control panel of said alarm system and a system warning device of said alarm system, said backup arrangement comprising in combination an electrical circuitry having an electronic switch circuit, a DC power source, a build-in electronic Hi-sounder, and a chargeable resistor;

said electronic switch circuit, which is an IC control system, having a power input connected to said auxiliary power output of said control panel and an alarm input connected to said alarm output of said control panel, said electronic switch circuit defining a normally opened switch and a normally closed switch, wherein said normally closed switch is coupled in series with said alarm output of said control panel and an input of said build-in electronic Hi-sounder;

said DC power source comprising at least a DC battery which output is coupled in series with said normally opened switch of said electronic switch circuit and said input of said build-in electronic Hi-sounder;

said chargeable resistor being connected between said DC power source and said power input for charging said DC power source when said backup arrangement is not in use and preventing current leakage of said DC power source so as to prolong a service span life of said DC power source; and said backup arrangement further comprising an alert output connected to an input of said system warning device of said alarm system, wherein when said control panel works normally, a voltage of said auxiliary power output of said control panel is high, said normally closed switch is in a close condition and said normally opened switch is in an open condition, and that said alarm output of said control panel is connected directly to said input of said system warning device via said alert output, wherein when either said control panel is vandalized that said auxiliary power output losses voltage or power thereof, or said system warning device is damaged, said normally closed switch is switched by said electronic switch circuit to an open condition and said normally opened switch is switched by said electronic switch circuit to a close condition, in order to connect said DC power source with said build-in electronic Hi-sounder to energize said build-in electronic Hi-sounder to provide Hi-pitch warning alarm.

2. A backup arrangement for an alarm system, as recited in claim 1, wherein said electronic switch circuit further comprises five transistors T1–T5, five resistors R1–R5, five diodes D1–D5, and a capacitor C1, two terminals of said power input being respectively connected with an input of said diode D1 and an output terminal of said transistor T1, an output of said diode D1 being connected in series with said resistor R2 which is further connected in series with a base terminal of said transistor T1, said resistor R3 being connected in parallel with said transistor T1, said capacity C1 being connected in parallel with said resistor R3, said input terminal of said transistor T1 being connected to a base terminal of said transistor T2 and said resistor R4, said resistor R4 being further connected to an output terminal of said transistor T3, an input terminal of said transistor T2 being connected to a base terminal of said transistor T3, an output terminal of said transistor T2 being connected to said output terminal of said transistor T1 and an output terminal of said transistor T4, an input terminal of said transistor T3 being connected to said resistor R1 and a base terminal of said transistor T4, an input terminal of said transistor T4 being connected to said output terminal of said transistor T3, said diode D3 being connected in parallel with said transistor T4, a negative terminal of said DC power source being connected in series with an input of said diode D3 and a positive terminal of said DC power source being connected to an input of said diode D4 and said chargeable resistor, two terminals of said alert output being respectively connected to an output of said diode D4 and an output of said diode D3, said chargeable resistor being further connected to an output of said diode D2, an input of said diode D2 being connected to said resistor R2 and an output terminal of said transistor T5, an input terminal of said transistor T5 being connected to said resistor R1 and an input of said diode D5, a base terminal of said transistor T5 being connected to said resistor R5 which is further connected with said normally opened switch means NO, said normally opened switch means NC being connected in series with said input of said diode D5, two terminals of said sounder input of said build-in electronic Hi-sounder being respectively connected to an output of said diode D5 and said output of said diode D3.

3. A backup arrangement for alarm system, as recited in claim 1, wherein said chargeable resistor has a resistance of 2 MK.

4. A backup arrangement for an alarm system, as recited in claim 2, wherein said chargeable resistor has a resistance of 2 MK.

5. A backup arrangement for an alarm system, as recited in claim 1, further comprising a fuse member, which is connected between said sounder input of said build-in electronic Hi-sounder and said alert output, for rendering said build-in electronic Hi-sounder ineffective during the installation of said backup arrangement and when said system warning device is manually and intentionally shorted.

6. A backup arrangement for an alarm system, as recited in claim 2, further comprising a fuse member, which is connected between said sounder input of said build-in electronic Hi-sounder and said alert output, for rendering said build-in electronic Hi-sounder ineffective during the installation of said backup arrangement and when said system warning device is manually and intentionally shorted.

7. A backup arrangement for an alarm system, as recited in claim 3, further comprising a fuse member, which is connected between said sounder input of said build-in electronic Hi-sounder and said alert output, for rendering said build-in electronic Hi-sounder ineffective during the installation of said backup arrangement and when said system warning device is manually and intentionally shorted.

8. A backup arrangement for an alarm system, as recited in claim 4, further comprising a fuse member, which is connected between said sounder input of said build-in electronic Hi-sounder and said alert output, for rendering said build-in electronic Hi-sounder ineffective during the installation of said backup arrangement and when said system warning device is manually and intentionally shorted.

9. A backup arrangement for an alarm system, as recited in claim 1, wherein said alert output is further connected to a voice warning device, which comprises a voice memory and amplifying circuitry connected to at lease a speaker.

10. A backup arrangement for an alarm system, as recited in claim 2, wherein said alert output is further connected to a voice warning device, which comprises a voice memory and amplifying circuitry connected to at lease a speaker.

11. A backup arrangement for an alarm system, as recited in claim 2, wherein said alert output is further connected to a voice warning device, which comprises a voice memory and amplifying circuitry connected to at lease a speaker.

12. A backup arrangement for an alarm system, as recited in claim 8, wherein said alert output is further connected to a voice warning device, which comprises a voice memory and amplifying circuitry connected to at lease a speaker.

13. A backup arrangement for an alarm system, as recited in claim 1, further comprising a test switch installed on said control panel by connecting between said power output of said control panel and said power input of said backup arrangement.

14. A backup arrangement for an alarm system, as recited in claim 2, further comprising a test switch installed on said control panel by connecting between said power output of said control panel and said power input of said backup arrangement.

15. A backup arrangement for an alarm system, as recited in claim 3, further comprising a test switch installed on said control panel by connecting between said power output of said control panel and said power input of said backup arrangement.

16. A backup arrangement for an alarm system, as recited in claim 8, further comprising a test switch installed on said control panel by connecting between said power output of said control panel and said power input of said backup arrangement.

17. A backup arrangement for an alarm system, as recited in claim 9, further comprising a test switch installed on said control panel by connecting between said power output of said control panel and said power input of said backup arrangement.

18. A backup arrangement for an alarm system, as recited in claim 12, further comprising a test switch installed on said control panel by connecting between said power output of said control panel and said power input of said backup arrangement.

* * * * *